US006695431B2

(12) United States Patent
Kumagai

(10) Patent No.: US 6,695,431 B2
(45) Date of Patent: Feb. 24, 2004

(54) LIQUID JET APPARATUS

(75) Inventor: Toshio Kumagai, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/241,755

(22) Filed: Sep. 12, 2002

(65) Prior Publication Data

US 2003/0067505 A1 Apr. 10, 2003

(30) Foreign Application Priority Data

Sep. 13, 2001 (JP) ..... P2001-277489

(51) Int. Cl.[7] ..... B41J 2/165
(52) U.S. Cl. ..... 347/35; 347/29; 347/34
(58) Field of Search ..... 347/35, 29, 30, 347/34, 22

(56) References Cited

FOREIGN PATENT DOCUMENTS

JP 191557 7/2001

*Primary Examiner*—Shih-Wen Hsieh
(74) *Attorney, Agent, or Firm*—Sughrue Mion, PLLC

(57) ABSTRACT

A liquid collection unit (33) is placed on a movement path of a liquid jet head mounted on a carriage. An opening portion (40) for receiving liquid, which are jetted from a liquid jet head, by performing a flushing operation is formed in the movement path of the liquid jet head. Liquid mist generated by performing a flushing operation is sucked by a fan (55) having blades (55*b*), and then caught and collected by the centrifugation action of a rotor portion (47) having a large number of flat fins (47*b*) on the internal surface of a cylindrical body (47*a*). A filter member (59) is disposed at an air outlet (58), from which air is caused by a fan (55) to flow out. A small amount of liquid mist, which is not collected by the roller part (47), is effectively collected by this filter member (59).

11 Claims, 6 Drawing Sheets

LIQUID JET APPARATUS

BACKGROUND OF THE INVENTION

This invention relates to an liquid jet apparatus which includes a liquid jet head, such as a recording head for an ink jet type recording apparatus, an electrode member ejection head for an electrode forming apparatus, an organic substance jet head for a bio chip manufacture apparatus, etc., and includes a liquid collection unit adapted to receive liquid droplets jetted when a flushing drive signal is supplied to this liquid jet head, the ink collection unit being placed on a movement path of the liquid jet head.

For example, a serial printing type ink jet recording apparatus, which is one kind of the liquid jet apparatus, includes a liquid jet head (hereinafter, referred as "ink jet type recording head"), which is mounted on a carriage and scans in a main scanning direction which is a width direction of a target (hereinafter, referred as "recording paper"), and a paper feed unit for conveying recording paper in a secondary scanning direction, which is perpendicular to the main scanning direction of the recording head. Liquid (hereinafter, referred as "ink droplets") are jetted from the recording head according to print data to thereby perform printing on the recording paper.

Such an ink jet type recording head is adapted to perform printing by jetting ink, which is pressurized in a pressure generating chamber, onto printing paper from nozzle orifices as ink droplets, and thus has a problem that a printing failure occurs owing to increase in ink viscosity and solidification of ink, which are caused by evaporation of ink solvent from the nozzle orifices, and to adhesion of dust to and entrainment of bubbles into ink. Thus, such a type of a recording apparatus includes a capping unit for sealing the nozzle orifices of the recording head during non-printing time, and also has a wiping member for wiping and cleaning a nozzle formation face as occasion arises.

The capping unit has not only the function of serving as a cover for preventing ink in the nozzle orifices of the recording head from being dried during printing is stopped, but also the function of receiving, when clogging of the nozzle orifices occurs, a negative pressure from a suction pump and then sucking and discharging ink from the nozzle orifices to thereby eliminate problems in that clogging of the nozzle orifices is caused owing to the solidification of ink, and that an ink jet failure is caused by entrainment of bubbles into ink passage.

A process of forcibly sucking and discharging ink so as to eliminate the problems of the clogging of the recording head and the state, in which the entrainment of the bubbles into the ink passage is caused, is referred to as a cleaning operation. This operation is performed, for instance, in the cases that printing is resumed after the long stop of the recording apparatus, and that when a user is aware of the deterioration in picture quality, the user operates, for example, a cleaning switch. Further, upon completion of sucking and discharging ink from the recording head, an operation of wiping the nozzle formation face of the recording head with the wiping member constituted by an elastic plate, such as a rubber plate, is performed.

The recording apparatus has the function of jetting ink droplets by applying a drive signal, which is irrelevant to printing, to the recording head. This is referred to as a flushing operation, and performed every predetermined cycle for the purpose of recovering an irregular meniscus caused in the vicinity of each of the nozzle orifices of the head and preventing an occurrence of clogging due to increase in viscosity of ink in a nozzle orifice, at which there are few opportunities to jet ink droplets during printing, by using the wiping member to thereby perform a wiping operation.

FIG. 6 shows an example of a conventional ink jet type recording apparatus configured so that during a flushing operation, ink droplets are jetted toward a flushing region formed on a movement path of the recording head. In FIG. 6, reference numeral 1 designates a carriage. This carriage 1 is configured in such a way as to perform reciprocating motions in an axial direction through a timing belt driven by a carriage motor (not shown) by being guided by a guide shaft 4 supported by a left-hand side frame 2 and a right-hand side frame 3.

An ink jet type recording head 5 is mounted on the carriage 1 in such a manner as to be directed downwardly. A black ink cartridge 6 and a color ink cartridge 7, which are used for supplying ink to the recording head 5, are detachably mounted on an upper part thereof. A paper feed member 8 is disposed under the recording head 5 correspondingly to the main scanning direction, and configured so that sheets of recording paper 9 put on this paper feed member 8 can be sequentially transported by a paper feed unit (not shown) in a secondary scanning direction of the recording head 5, which is perpendicular to the main scanning direction thereof.

In the figure, reference numeral 10 denotes a capping unit placed on a non-printing region (including a home position), and configured so that when the recording head 5 moves to a place just thereabove, the capping unit 10 can upwardly move and seal the nozzle formation face of the recording head 5. Further, a suction pump 11 for giving a negative pressure to the internal space of the capping unit 10 is placed in close vicinity to the capping unit 10.

The capping unit 10 has not only the function of serving as a cover, which prevents ink in the nozzle orifices of the recording head 5 from being dried during printing is stopped, as above described, but also the function of serving as a cleaning unit that causes a negative pressure from the suction pump 11 to act upon the recording head 5 thereby to suck and discharge ink therefrom. A wiping member 12 constituted by an elastic plate, such as a rubber plate, is disposed in a printing region adjacent to the capping unit 10, and configured so that when the carriage 1 performs reciprocating motions between the home position and the capping unit 10, a wiping operation of wiping the nozzle formation face of the recording head 5.

On the other hand, a flushing region 13 is formed in the proximity of the other end opposed to the capping unit 10 through a central printing region. This flushing region 13 is constituted by an opening hole formed in such a way as to penetrate the paper feed member 8. A part of a waste liquid absorber 14 for absorbing and holding ink discharged from the capping unit 10 through the suction pump 11 is disposed on the internal bottom part of the opening hole constituting the flushing region 13.

Meanwhile, the aforementioned recording apparatus is configured so that flushing is periodically performed in order to prevent an occurrence of a jet failure due to increase in viscosity of ink in a disused nozzle. Especially, in the latest model of such a recording apparatus, tens of flushing shots are performed at each nozzle every several seconds on average. This flushing operation is performed in order to prevent an occurrence of color mixture after the cleaning operation, or at the time of commencing printing, or during printing, so that several to tens of thousands of shots may be periodically jetted from each nozzle.

In the case that an opening hole is formed in the paper feed member 8 as the flushing region 13, as illustrated in FIG. 6, the distance from the nozzle formation face of the recording head 5 to the waste liquid absorbing member 14 is several tens of millimeters. Therefore, a flying distance of an ink droplet inevitably increases. Thus, apart of ink droplets jetted from the nozzle orifice of the recording head become mist (that is, atomized ink) owing to air resistance before reaching the absorbing member 14. The mist floats, as indicated by arrows. Consequently, this causes a problem in that the inside and outside of the apparatus including recording paper are contaminated.

The ink droplets jetted from the nozzle orifices are charged to no small extent. Therefore, such ink droplets are affected by static electricity, which is generated in a drive part in the recording apparatus, and accelerated by airflows generated by an exhaust fan, which is placed in such a way as to suppress rise in the internal temperature of the apparatus, or caused by the movement of the carriage. Thus, there has yet been the unsolved problem in that the inside and outside of the apparatus including recording paper are contaminated. Such problems are more tangible, especially, in the recent recording apparatus adapted to control the quantity of each ink droplet in such a manner as to be small as much as possible in order to realize high picture quality.

SUMMARY OF THE INVENTION

The invention is accomplished in view of the aforementioned problems. Accordingly, an object of the invention is to provide a liquid jet apparatus enabled to effectively catch and collect liquid mist, which becomes micro-droplets and floats, especially, when a flushing operation is performed, to thereby prevent the inside and outside of the apparatus from being contaminated.

In order to solve the aforesaid object, the invention is characterized by having the following arrangement.

(1) A liquid jet apparatus comprising:
- a liquid jet head mounted on a carriage scanning in a direction of width of a target, for jetting liquid from nozzle orifices and applying the liquid to the target; and
- an liquid collection unit disposed on a movement path of the liquid jet head, for receiving liquid jetted when a flushing drive signal is supplied to the liquid jet head, the liquid collection unit including,
  - a unit box including an opening portion for receiving liquid jetted at the time of a flushing operation of the liquid jet head,
  - a suction unit for sucking air contained in the unit box, and
  - a rotor portion for catching liquid, generated by the flushing operation and sucked into the unit box together with air, by a centrifugation action.

(2) The liquid jet apparatus according to (1), wherein
- a guide tube communicating with the opening portion for receiving liquid in a direction of gravity is formed in the opening portion,
- an eyehole is formed in a side wall of the guide tube, and
- the sucked air is led to a position of a substantially center of rotation of the rotor portion.

(3) The liquid jet apparatus according to (2), wherein
- a slope inclined to a direction of gravity is formed in the opening portion for receiving liquid, and
- the guide tube is formed in a bottom portion of the slope in the direction of gravity so as to communicated therewith.

(4) The liquid jet apparatus according to (1), wherein the rotor portion includes:
- a cylindrical body to be driven to rotate in a circumferential direction thereof; and
- a plurality of flat fins arranged along an axial direction on an inner circumferential surface of the cylindrical body.

(5) The liquid jet apparatus according to (4), wherein a plurality of through holes are formed in the cylindrical body of the rotor portion, and a waste liquid collection housing is formed so as to surround a circumferential surface of the cylindrical body.

(6) The liquid jet apparatus according to (5), wherein
- a guide tube communicating with the opening portion for receiving liquid in a direction of gravity is formed in the opening portion, and
- an eyehole communicating with the guide tube is formed in a lower base part of the waste liquid collection housing so that collected waste liquid is enabled to be drained through the eyehole to the guide tube.

(7) The liquid jet apparatus according to (2), wherein a lower end part of the guide tube is opened to allow waste liquid, which is transmitted in the guide tube, to drop to waste liquid tank placed just under the guide tube.

(8) The liquid jet apparatus according to (1), wherein the rotor portion and the suction unit are driven by a single drive motor to rotate.

(9) The liquid jet apparatus according to (8), wherein the rotor portion and a suction fan constituting the suction unit are respectively attached to opposite end parts of a motor drive shaft across the drive motor so that an air passage, through which air flowing from the opening portion formed in the unit box is exhausted by the suction fan through the rotor portion, is formed.

(10) The liquid jet apparatus according to (8), wherein the suction fan of the suction unit is constituted by a centrifugal fan including a disk member to be driven by the drive motor, and a plurality of blade members radially arranged on a side surface of the disk member.

(11) The liquid jet apparatus according to (10), wherein
- a cylindrical cover member is disposed to surround the centrifugal fan,
- an air outlet, from which air sucked by the centrifugal fan is exhausted, is formed in a part of a circumferential surface of the cylindrical cover member, and
- a filter member is placed at the air outlet.

DETAILED DESCRIPTION OF PREFERRED EMBODIMENTS

Figure 1:
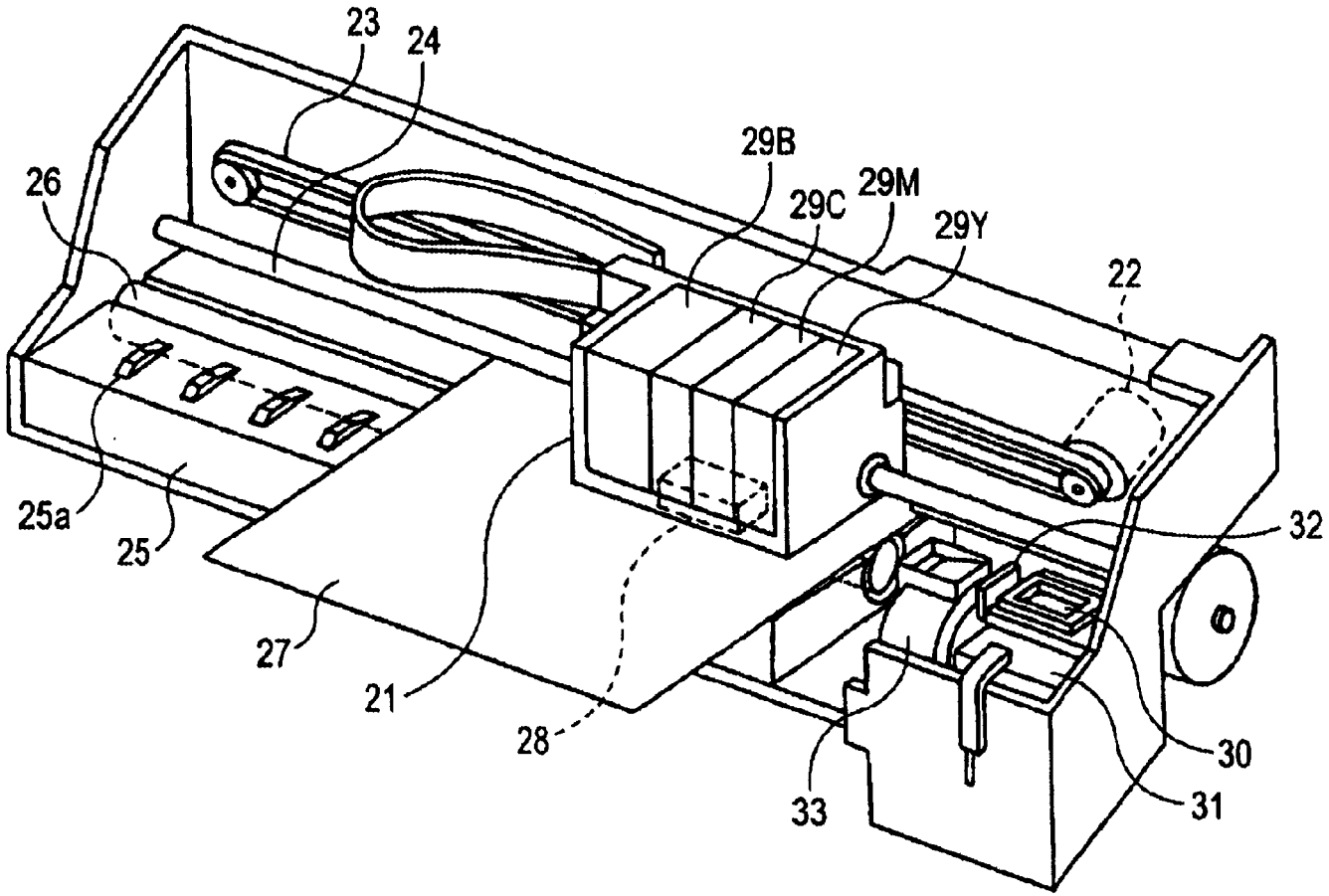
FIG. 1 is a perspective view illustrating a basic configuration of a recording apparatus body to which this invention is applied.

Hereinafter, an embodiment of an ink jet type recording apparatus according to this invention is described with reference to the accompanying drawings. FIG. 1 is a perspective view illustrating the basic configuration of a recording apparatus body to which this invention is applied. In FIG. 1, reference numeral 21 designates a carriage. This carriage 21 is configured in such a way as to be guided by a guide member 24 and to be reciprocatingly moved in the main scanning direction along the longitudinal direction of a paper feed member 25.

A paper feed roller 26 is disposed in the paper feed member 25. Recording paper 27 put between this paper feed roller 26 and a driven roller (not shown) is conveyed in a secondary scanning direction, which is perpendicular to the main scanning direction, by driving the paper feed roller 26 to rotate. A large number of projection parts 25*a* each having a slope extending in the secondary scanning direction are intermittently formed on the top surface of the paper feed member 25 along the longitudinal direction thereof. The recording paper 27 is conveyed along the top surface of these projection parts 25*a*, so that a predetermined gap is formed between the paper feed member 25 and a recording head (to be described)

On the other hand, as indicated by dashed lines, an ink jet type recording head 28 is mounted on the bottom surface of the carriage 21, which faces the recording paper 27. Moreover, a black ink cartridge 29B, which supplies black ink to the recording head 28, and color ink cartridges 29C, 29M, and 29Y, each of which is filled with corresponding cyan ink, magenta ink, or yellow ink, are detachably mounted on an upper part thereof in such a manner as to adjoin to one another in the main scanning direction.

In the figure, reference numeral 30 denotes a capping unit disposed in a non-printing region (including a home position). This capping unit 30 is configured in such a way as to be able to upwardly move and seal the nozzle formation face (that is, the bottom surface of the recording head 28) of the recording head when the recording head 28 moves to a place just thereabove. A suction pump 31 for giving a negative pressure to the internal space of the capping unit 30 is placed in such a manner as to adjoin to the capping unit 30.

The capping unit 30 has not only the function of serving as a cover, which prevents ink in the nozzle orifices of the recording head 28 from being dried during printing is stopped, but the function of performing a cleaning operation of causing a negative pressure from the suction pump 31 to act upon the recording head 28 thereby to suck and discharge ink therefrom.

As shown in FIG. 1, a wiping member 32 formed like strips from an elastic material, such as rubber, is disposed in a printing region adjacent to the capping unit 30, and configured so that when the carriage 21 performs reciprocating motions between the home position and the capping unit 30, a wiping operation of horizontally advancing to and retreating from the movement path of the recording head as occasion demands, to thereby wipe and clean the nozzle formation face of the recording head 28.

In this embodiment, an ink collection unit 33 is placed just under the movement path of the recording head 28 provided between the paper feed member 25 and the wiping member 32. This ink collection unit 33 is configured in such a manner as to be able to receive ink droplets discharged from the recording head 28 and catch ink mist generated by performing a flushing operation when the recording head 28 faces this ink collection unit by being placed just thereabove.

Figure 2:
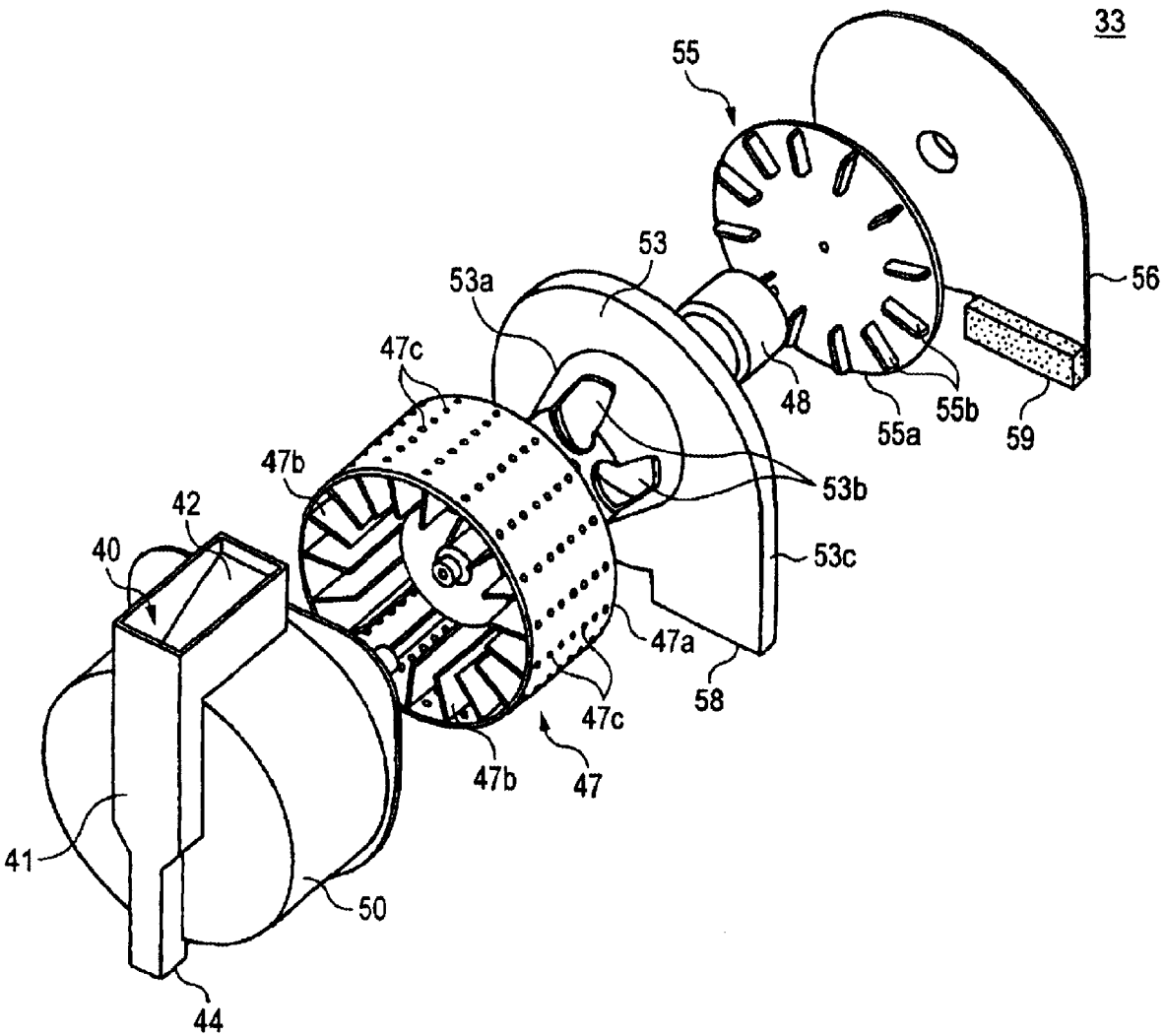
FIG. 2 is an exploded perspective view illustrating the configuration of an ink collection unit equipped in the recording apparatus shown in FIG. 1.
Figure 3:
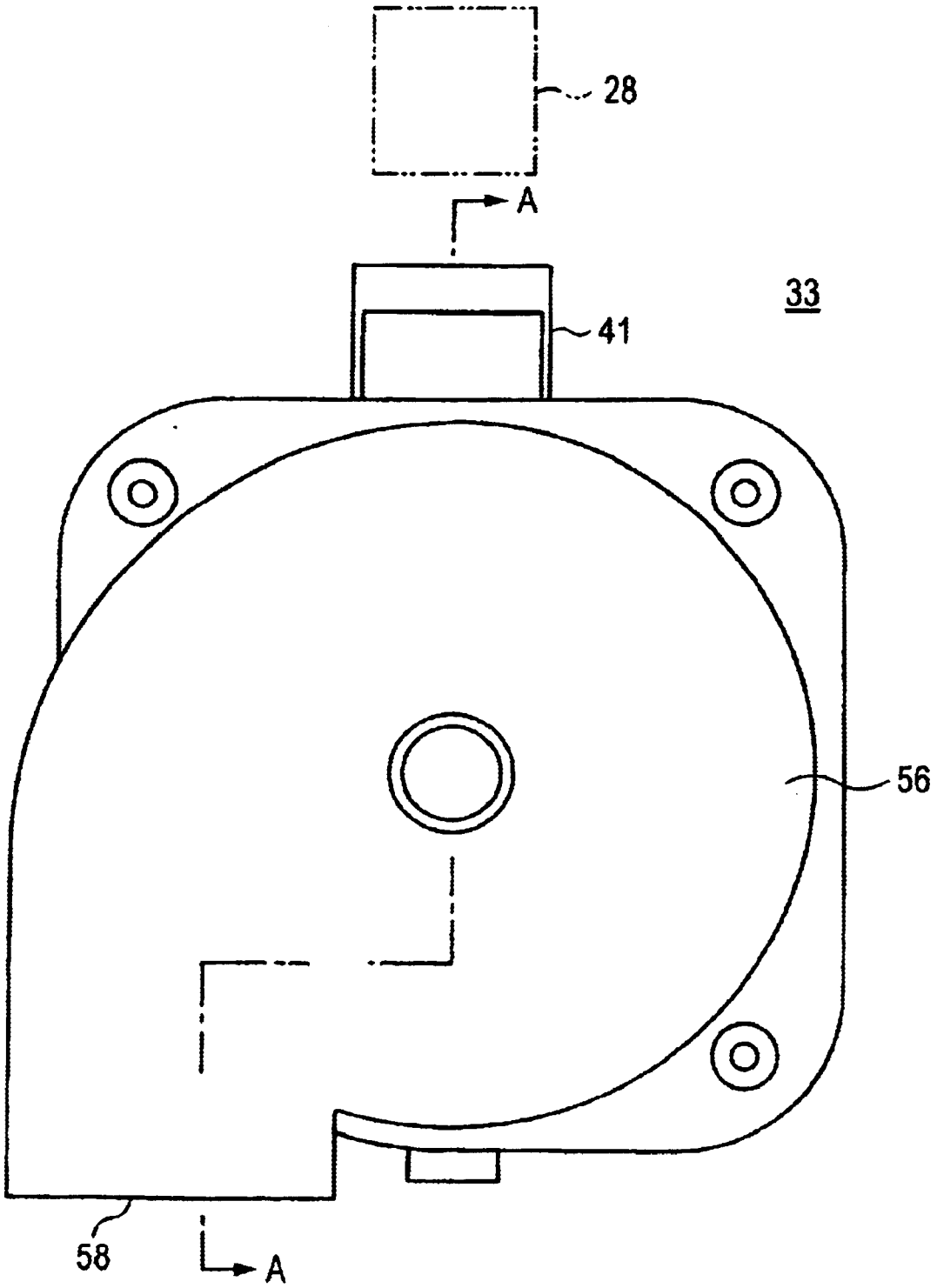
FIG. 3 is a side view illustrating a state of the ink collection unit, which is taken from the side of a suction unit.
Figure 4:
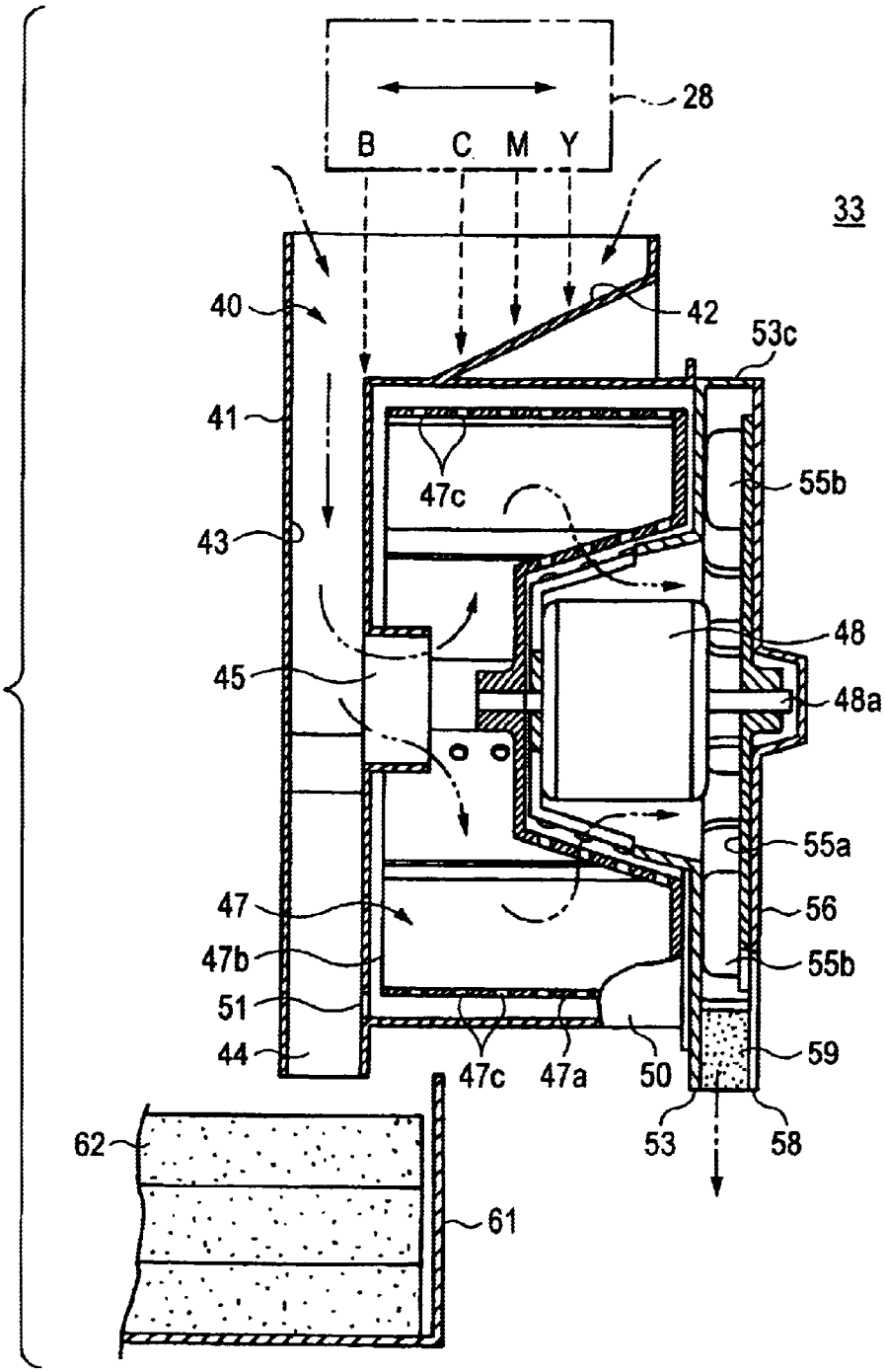
FIG. 4 is a sectional view taken in the direction of arrows along the line A—A of FIG. 3.
Figure 5:
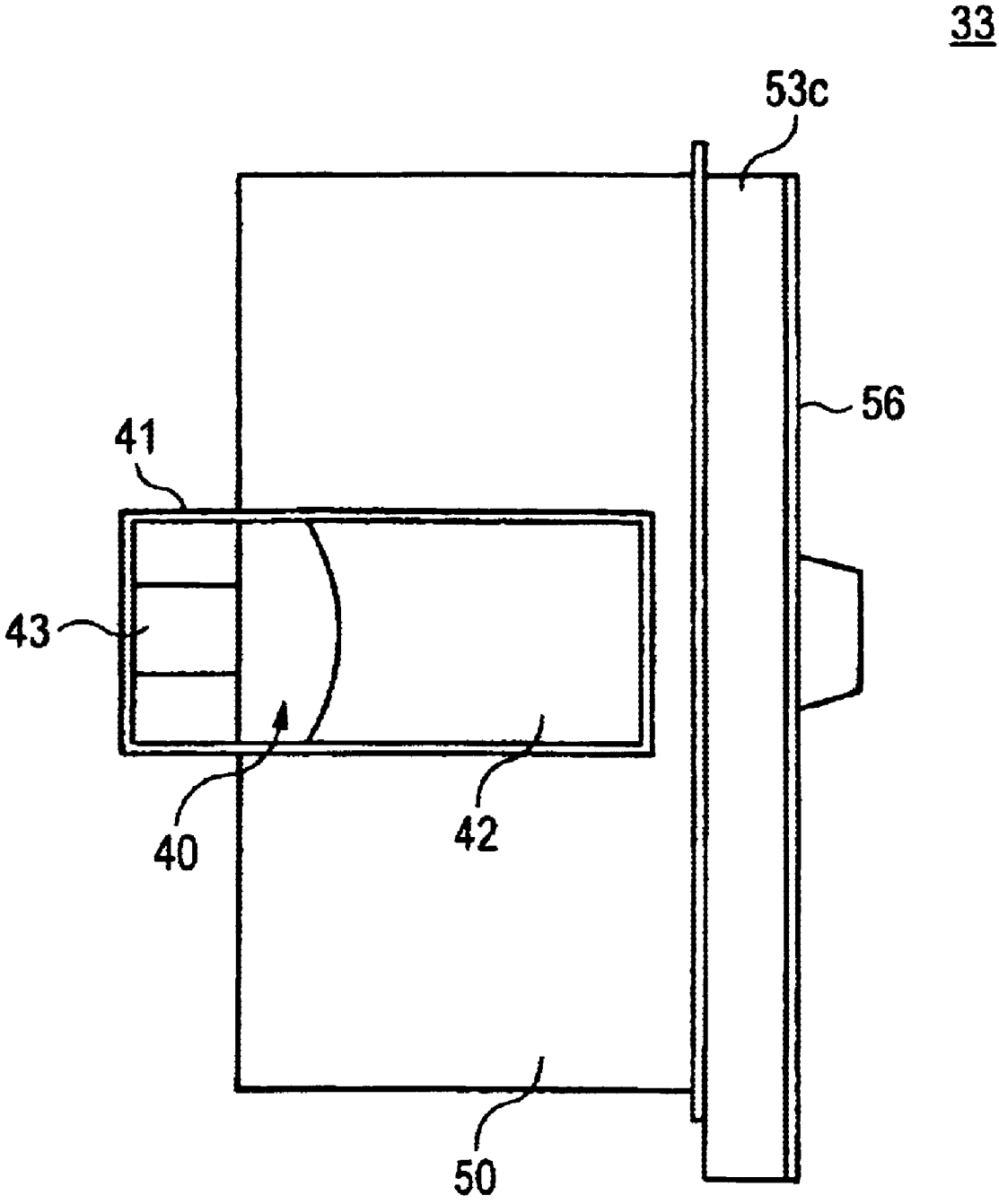
FIG. 5 is a plan view illustrating the ink collection unit, which is taken from above.
Figure 6:
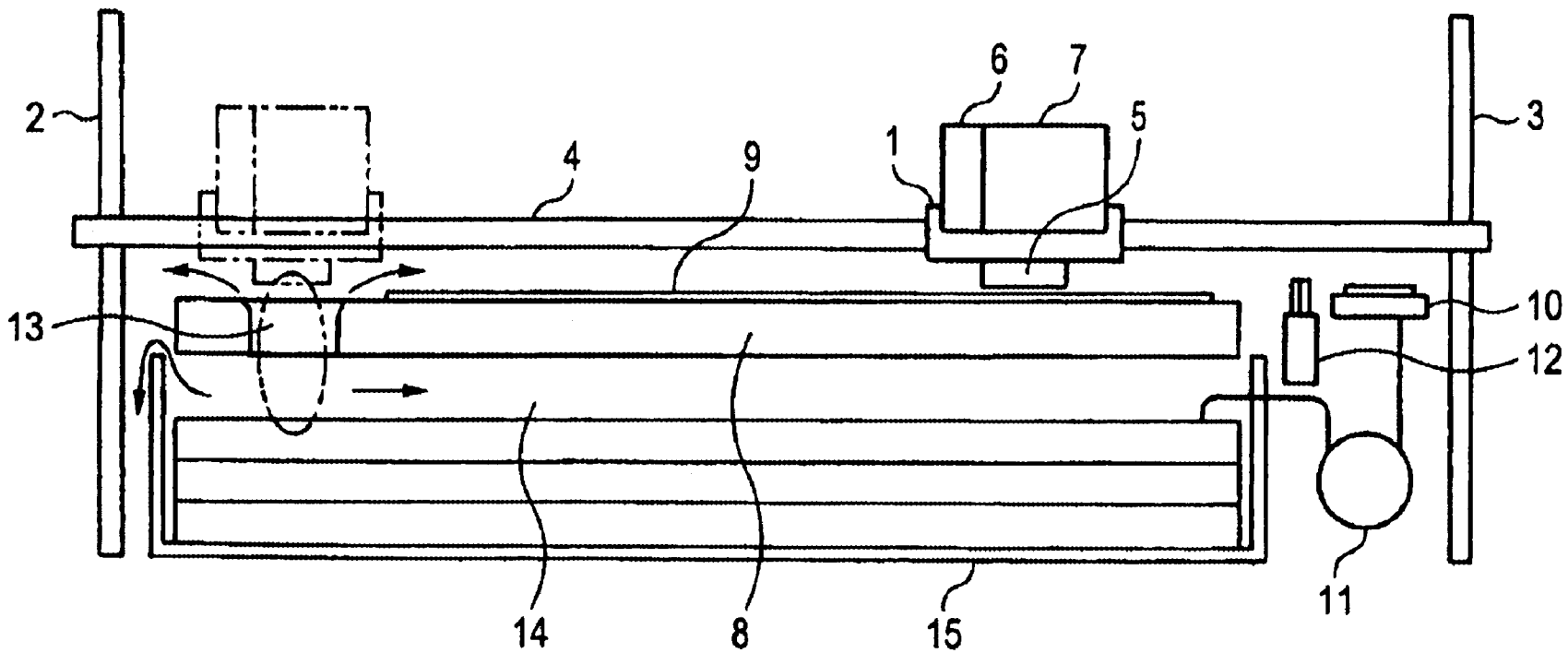
FIG. 6 is a longitudinally sectional view illustrating an example of a flushing region formed in a conventional ink jet type recording apparatus.

FIGS. 2 to 5 illustrate the constitution of the ink collection unit 33. FIG. 2 is an exploded perspective view illustrating the ink collection unit 33. FIG. 3 is a side view illustrating the ink collection unit 33, which is taken from the side of a suction unit (to be described later). FIG. 4 is a sectional view taken in the direction of arrows along the line A—A of FIG. 3. FIG. 5 is a plan view illustrating the ink collection unit 33, which is taken from above.

This ink collection unit 33 includes a unit box 41, at the upper part of which an opening portion 40 for receiving ink droplets jetted according to a flushing operation of the recording head 28 is provided. That is, the recording head 28 indicated by imaginary lines shown in FIG. 4 is configured in such a way as to be caused to scan in the lateral direction, as viewed in FIG. 4 (that is, the direction of arrows indicated at the recording head 28). Aslope 42 inclined in the direction of gravity is formed in the opening portion 40 of this unit box 41. Ink droplets jetted from the recording head 28, which faces the opening portion 40, according to the flushing operation are received mainly by the slope 42. Consequently, the frequency of generation of ink mist due to rebound ink droplets can be reduced.

As illustrated in FIG. 4, a guide tube 43 to be communicated with the opening portion in the direction of gravity is formed the bottom part in the direction of gravity of the slope 42 in the unit box 41. Therefore, ink droplets received on the slope 42 downwardly flow along the slope 42 and then run down the guide tube 43 communicated therewith in the direction of gravity. The bottom part of the guide tube 43 is opened. An ink outlet 44 is formed therein. A waste liquid tank 61 is disposed just under this ink outlet 44. Therefore, the ink waste liquid transmitting in the guide tube 43 is dropped to a waste liquid absorbing material 62 accommodated in the waste liquid tank 61, and absorbed and held by the waste liquid absorbing material 62.

Meanwhile, as illustrated in FIG. 4, a cylindrical eyehole 45 formed in a side wall of the guide tube 43. Air sucked by a suction unit (to be described later) is led to about the position of the center of rotation of a rotor portion (to be described later) through this eyehole 45. Therefore, ink mist, which is generated by impingement of ink droplets upon the slope 42, and ink mist, which is generated during ink droplets fly, are reliably sucked into the guide tube 43, which is communicated with the opening portion 40, and led to about the position of the center of rotation of the rotor portion through the eyehole 45 formed in the side wall of the guide tube 43.

As illustrated in FIGS. 2 and 4, the rotor portion 47 is attached to an end part of a drive shaft 48*a* of a drive motor 48, and includes a cylindrical body 47*a* to be driven to rotate in a circumferential direction, a plurality of flat fins 47*b* arranged on the internal circumferential surface of this cylindrical body 47*a* at equal intervals along an axial direction, and a plurality of through holes 47*c* formed in such a manner as to penetrate the cylindrical body 47*a*. A waste liquid collection housing 50 is formed in such a way as to surround the circumferential surface of the cylindrical body 47*a* of the rotor portion 47 and as to be integral with the unit box 41.

Therefore, ink mist, which is sucked by a suction unit (to be described later) by a rotational driving operation of the drive motor 48 into the unit box 41 together with air, is led to about the position of the center of rotation of the rotor portion 47. Then, the ink mist undergoes a rotation action of the flat fins 47*b* formed in the rotor portion 47 and thus is drawn to the inner circumferential surface of the cylinder body 47*a*. Subsequently, such ink mist is caught by a centrifugation action and collected as ink waste liquid. Then, the collected ink waste liquid is caused to fly to the outer circumferential surface of the cylindrical body 47*a* through a plurality of through holes 47*c* formed in the cylindrical body 47, and received by the waste liquid collection housing 50.

Meanwhile, an eyehole 51, which is communicated with the guide tube 43, is formed in the lower base part of the waste liquid collection housing 50, as shown in FIG. 4. The ink waste liquid collected by the centrifugation action of the rotor portion 47 is transmitted on the inner circumferential surface of the housing 50 and falls in the eyehole part 51 formed in the bottom part in the direction of gravity thereof. Such ink waste liquid is exhausted to the guide tube 43 through the eyehole 51. Thus, the ink waste liquid collected by the centrifugation action of the rotor portion 47 is dropped through the guide tube 43 from the ink outlet 44 provided at the bottom part thereof to the waste liquid absorbing material 62 accommodated in the waste liquid tank 61.

The drive motor 48 is mounted in a concave part 53*a* formed nearly in the central part of a motor frame 53. An air vent 53*b* having a relatively large diameter is formed in this concave part 53*a*. The motor frame 53 blocks up the waste liquid collection housing 50 at an end face thereof. A suction fan 55 of the suction unit is attached to the other end part of the drive shaft 48*a* of the drive motor 48. The suction fan 55 is constituted by a centrifugal fan consisting of a disk-like member 55*a*, which is driven by the drive motor 48 to rotate, and a plurality of blade members 55*b* radially arranged on a side surface of the disk-like member.

A cylindrical cover member 53*c* is formed in such a manner as to surround the centrifugal fan 55 of the suction unit and as to be integral with the motor frame 53. A cover 56 is placed on the other side surface of the disk-like member 55*a* of the centrifugal fan 55. The cover 56 blocks up a cylindrical cover member 53*c* at an end face thereof in such a way as to surround the centrifugal fan 55.

An air outlet 58 for exhausting air sucked by the centrifugal fan 55 is formed in a part of the circumferential surface of the cylindrical cover member 53*c*. Sucked air is exhausted from the air outlet 58 by driving the centrifugal fan 55 to perform a right-handed rotation (that is, rotate clockwise) in the state shown in FIG. 2. Consequently, an air passage indicated by two-dot chain lines, from which air flowing from the opening portion 40 formed in the unit box 41 is exhausted by the centrifugal fan 55 through the rotor portion 47, is formed.

A filter member 59 formed like a rectangle is attached to the inner surface of air outlet 58 of the cover 56 by, for example, an adhesive or double-stick tape (not shown), and configured so that the filter member 59 is positioned at the air outlet 58 when the cover 56 blocks up the cylindrical cover member 53*c* at the end face thereof. With this configuration, a small amount of ink mist, which is not collected by the centrifugal action of the rotor 47, is effectively collected by this filter member 59. Thus, this embodiment can effectively collect a small amount of residual ink mist and contribute to the reduced quantity of the consumed filter member, which is relatively costly, by placing the filter member 59 at the air outlet 58.

Incidentally, in the aforementioned embodiment, a straight guide tube 43 formed in such a manner as to extend in the direction of gravity is placed in such a way as to be communicated with the opening portion 40 for receiving ink droplets from the recording head 28 according to the flushing operation. Furthermore, the ink outlet 44 is formed at the bottom part of the guide tube 43. However, the invention is not limited to the aforementioned specific configuration. Applicant of the present application has already filed, for example, Japanese Patent Publication No. 2001-191557 disclosing a configuration of an ink collection unit, in which a sequential air-passage formed by being folded up and down in the direction of gravity and in the direction of antigravity is formed in a unit box of the opening portion for receiving ink droplets from the recording head due to a flushing operation. A configuration, in which the rotor portion and the suction unit are placed at an end part of this air passage, maybe employed as that of an ink jet type recording apparatus according to the invention.

In the case of employing such a configuration, effects of collecting ink mist can be obtained in the sequential air-passage formed by being folded up and down in the direction of gravity and in the direction of antigravity is formed in the unit box. Moreover, ink mist can be caught by the centrifugal action of the rotor portion. Thus, this invention can provide an ink jet type recording apparatus enabled to synergetically enhance the efficiency in collecting ink mist.

Further, although the ink collection unit is placed at the side of the home position, at which the capping unit is disposed, in the aforementioned embodiment, the ink collection unit may be placed at the side of an end part opposed to the home position across the printing region. Furthermore, if necessary, the ink collection unit may be placed at each of the side of the home position and the side of an end part of the printing region, which part faces the home position across the printing region.

Incidentally, in the above embodiments, the description is described with reference to the ink jet type recording apparatus which is a kind of the liquid jet apparatus. However, the present invention can be applied to other kind of liquid jet apparatus, for example, an electrode member ejection head for an electrode forming apparatus, an organic substance jet head for a bio chip manufacture apparatus, etc.

As is obvious from the foregoing description, in the liquid jet apparatus according to this invention, the ink collection unit comprises the unit box having an opening portion for receiving liquid jetted when a flushing driving signal is supplied to a liquid jet head, the suction unit for sucking air contained in the unit box, and the rotor portion for catching liquid mist, which is generated by the flushing operation and sucked into the unit box together with air, by a centrifugation action. Thus, liquid mist can effectively be caught and collected as waste liquid. Therefore, this invention can provide a liquid jet apparatus enabled to solve the problem in that the inside and outside of the apparatus are contaminated by the liquid jetted in the flushing operation.

What is claimed is:

1. A liquid jet apparatus comprising:

a liquid jet head mounted on a carriage scanning in a direction of width of a target, for jetting liquid from nozzle orifices and applying the liquid to the target; and an liquid collection unit disposed on a movement path of the liquid jet head, for receiving liquid jetted when a flushing drive signal is supplied to the liquid jet head, the liquid collection unit including, a unit box including an opening portion for receiving liquid jetted at the time of a flushing operation of the liquid jet head, a suction unit for sucking air contained in the unit box, and a rotor portion for catching liquid, generated by the flushing operation and sucked into the unit box together with air, by a centrifugation action.

2. The liquid jet apparatus according to claim 1, wherein a guide tube communicating with the opening portion for receiving liquid in a direction of gravity is formed in the opening portion, an eyehole is formed in a side wall of the guide tube, and the sucked air is led to a position of a substantially center of rotation of the rotor portion.

3. The liquid jet apparatus according to claim 2, wherein a slope inclined to a direction of gravity is formed in the opening portion for receiving liquid, and the guide tube is formed in a bottom portion of the slope in the direction of gravity so as to communicated therewith.

4. The liquid jet apparatus according to claim 2, wherein a lower end part of the guide tube is opened to allow waste liquid, which is transmitted in the guide tube, to drop to waste liquid tank placed just under the guide tube.

5. The liquid jet apparatus according to claim 1, wherein the rotor portion includes:

a cylindrical body to be driven to rotate in a circumferential direction thereof; and a plurality of flat fins arranged along an axial direction on an inner circumferential surface of the cylindrical body.

6. The liquid jet apparatus according to claim 5, wherein a plurality of through holes are formed in the cylindrical body of the rotor portion, and a waste liquid collection housing is formed so as to surround a circumferential surface of the cylindrical body.

7. The liquid jet apparatus according to claim 6, wherein a guide tube communicating with the opening portion for receiving liquid in a direction of gravity is formed in the opening portion, and an eyehole communicating with the guide tube is formed in a lower base part of the waste liquid collection housing so that collected waste liquid is enabled to be drained through the eyehole to the guide tube.

8. The liquid jet apparatus according to claim 1, wherein the rotor portion and the suction unit are driven by a single drive motor to rotate.

9. The liquid jet apparatus according to claim 8, wherein the rotor portion and a suction fan constituting the suction unit are respectively attached to opposite end parts of a motor drive shaft across the drive motor so that an air passage, through which air flowing from the opening portion formed in the unit box is exhausted by the suction fan through the rotor portion, is formed.

10. The liquid jet apparatus according to claim 8, wherein the suction fan of the suction unit is constituted by a centrifugal fan including a disk member to be driven by the drive motor, and a plurality of blade members radially arranged on a side surface of the disk member.

11. The liquid jet apparatus according to claim 10, wherein a cylindrical cover member is disposed to surround the centrifugal fan, an air outlet, from which air sucked by the centrifugal fan is exhausted, is formed in a part of a circumferential surface of the cylindrical cover member, and a filter member is placed at the air outlet.

* * * * *